US009145751B2

(12) United States Patent
Organ

(10) Patent No.: US 9,145,751 B2
(45) Date of Patent: Sep. 29, 2015

(54) HYDRAULIC ACCUMULATORS

(71) Applicant: Vetco Gray Controls Limited, Bristol (GB)

(72) Inventor: Mark Edwin Organ, Bristol (GB)

(73) Assignee: GE Oil & Gas UK Limited, Bristol (GB)

( * ) Notice: Subject to any disclaimer, the term of this patent is extended or adjusted under 35 U.S.C. 154(b) by 0 days.

(21) Appl. No.: 14/168,154

(22) Filed: Jan. 30, 2014

(65) Prior Publication Data

US 2014/0209315 A1 Jul. 31, 2014

(30) Foreign Application Priority Data

Jan. 30, 2013 (EP) ..... 13153317

(51) Int. Cl.
*E21B 33/035* (2006.01)
*E21B 33/064* (2006.01)
*F15B 1/02* (2006.01)

(52) U.S. Cl.
CPC ..... *E21B 33/0355* (2013.01); *E21B 33/064* (2013.01); *F15B 1/022* (2013.01); *F15B 2201/205* (2013.01); *F15B 2201/50* (2013.01)

(58) Field of Classification Search
CPC ... E21B 33/0355; E21B 33/064; F15B 1/022; F15B 2201/50
USPC ..... 166/336, 344, 351, 363, 368
See application file for complete search history.

(56) References Cited

U.S. PATENT DOCUMENTS

2013/0305829 A1* 11/2013 Eriksen ..... 73/700

FOREIGN PATENT DOCUMENTS

FR 2585086 A1 1/1987
WO 2012078048 A1 6/2012

OTHER PUBLICATIONS

European Search Report and Written Opinion dated Aug. 11, 2012 with was issued in connection with lasped European Patent Application No. 12165027.9 which was filed on Apr. 20, 2012.
European Search Report and Written Opinion dated Jul. 8, 2013 with was issued in connection with European Patent Application No. 13153317.6 which was filed on Jan. 30, 2013.

* cited by examiner

*Primary Examiner* — Matthew Buck
(74) *Attorney, Agent, or Firm* — GE Global Patent Operation

(57) ABSTRACT

A hydraulic accumulator assembly in which a hydraulic accumulator is associated with at least one responsive unit, which is responsive to the weight of the accumulator to provide an indication dependent on the weight of the accumulator. The accumulator is in an underwater fluid extraction well facility.

16 Claims, 4 Drawing Sheets

HYDRAULIC ACCUMULATORS

BACKGROUND OF THE INVENTION

Embodiments of the present invention relate to hydraulic accumulators, in particular one in an underwater (for example subsea) fluid extraction well facility.

Following the Gulf of Mexico oil well disaster in 2010, a general customer and industry requirement was identified to have the ability to indicate how much volume is stored in a hydraulic accumulator associated with a subsea fluid extraction well facility. It is believed that insufficient accumulated volume contributed to the ineffectiveness of the subsea valves and shear rams to fully shut-in the well. Hence, there is a need to provide an indication of accumulated volume in a hydraulic accumulator to provide increased confidence that safety critical systems (valves, shear rams, etc.) will have sufficient hydraulic power available to them to close as required.

FR2585086 discloses a hydraulic accumulator assembly in which a hydraulic accumulator is associated with at least one means responsive to the weight of the accumulator to provide an indication dependent on the weight of the accumulator.

BRIEF SUMMARY OF THE INVENTION

According to embodiments of the present invention, there is provided a hydraulic accumulator assembly in which a hydraulic accumulator is associated with at least one means responsive to the weight of the accumulator to provide an indication dependent on the weight of the accumulator, characterised in that the accumulator comprises a hydraulic accumulator in an underwater fluid extraction well facility. A cover for the accumulator could be carried by the support means, in an embodiment, there being a collar at the top of the cover for constraining the accumulator horizontally.

The assembly could include support means which support the accumulator, the at least one responsive means being responsive to a force applied to a part of the support means by the weight of the accumulator.

In one embodiment, the support means comprises a first support member to which the accumulator is attached and a second support member for the first support member, the at least one responsive means being responsive to a force between the first and second support members. In this case, the first support member could be at least partially received by the second support member. Such a cover for the accumulator could be carried by the second support member. Hydraulic input and output interfaces in the second support member could communicate with passageways in the first support member for supplying fluid to and receiving fluid from the accumulator, and the interfaces could communicate with the passageways via flexible hoses. Alternatively, there could be a single hydraulic input and output in communication with the accumulator, for example provided by a flexible hose.

In another embodiment, the support means comprises a support member to which the accumulator is attached and at least one further member attached by attachment means to the support member, the at least one responsive means being responsive to a force applied to the attachment means. In this case, such a cover for the accumulator could be carried by the at least one further member. Hydraulic input and output interfaces in the at least one further member could communicate with passageways in the support member for supplying fluid to and receiving fluid from the accumulator, and the interfaces could communicate with the passageways via flexible hoses. Alternatively, there could be a single hydraulic input and output in communication with the accumulator, for example provided by a flexible hose. The at least one further member could be above the support member in use of the assembly.

In embodiments of the present invention, the at least one responsive means comprises at least one of a strain gauge, a force gauge, a force meter, a balance scale, a spring force scale, a strain gauge based electronic scale and a fluid-based means of weight measurement.

In embodiments of the present invention in which a cover for the accumulator is provided, the accumulator may be constrained horizontally by a collar at the top of the cover.

Typically, an assembly according to an embodiment of the present invention is provided with means for receiving and processing data resulting from the indication dependent on the weight of the accumulator.

An embodiment of the present invention also comprises a method of monitoring the volume of a fluid in a hydraulic accumulator, the method comprising, including the accumulator in an assembly according to an embodiment of the present invention and using the at least one responsive means to provide an indication of the weight of the accumulator.

The various features of novelty which characterize the invention are pointed out with particularity in the claims annexed to and forming a part of this disclosure. For a better understanding of the invention, its operating advantages and benefits obtained by its uses, reference is made to the accompanying drawings and descriptive matter. The accompanying drawings are intended to show examples of the many forms of the invention. The drawings are not intended as showing the limits of all of the ways the invention can be made and used. Changes to and substitutions of the various components of the invention can of course be made. The invention resides as well in sub-combinations and sub-systems of the elements described, and in methods of using them.

DETAILED DESCRIPTION OF THE EXEMPLARY EMBODIMENTS OF THE INVENTION

Figure 1:
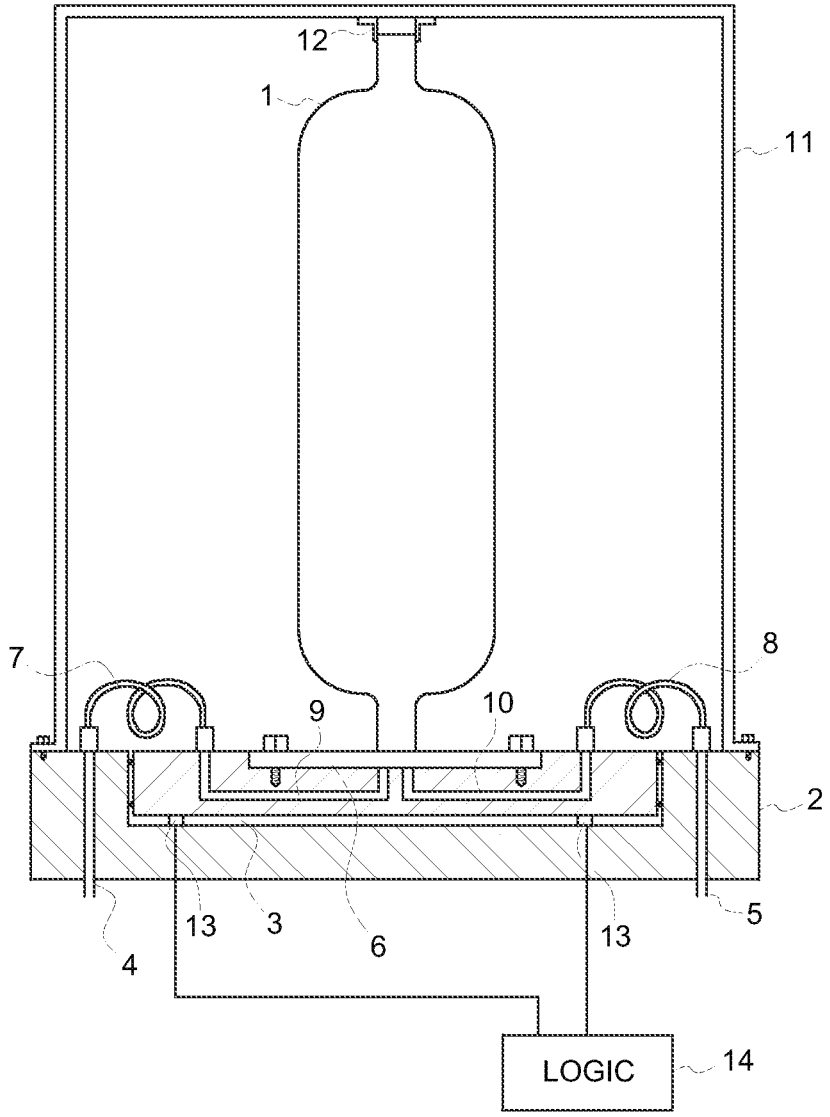
FIG. 1 is a schematic diagram of an embodiment of the present invention.

FIG. 1 illustrates an assembly according to an embodiment of the invention. The assembly including a hydraulic accumulator 1 in a subsea fluid extraction well facility. The assembly is mounted on two support members in the form of plates, namely a larger plate 2 inside which there is a smaller, secondary plate 3. The larger plate 2 houses the primary input and output for hydraulic fluid via input and output interfaces 4 and 5 respectively, the second plate 3 being mounted in a recess in the top of the larger plate 2. The accumulator 1 is bolted on to the smaller plate 3 using, in an embodiment, a regular flange interface 6. The plates 2 and 3 are connected via a means which enables transfer and containment of pressurised hydraulic fluid, but does not constrain the plate 3 in the vertical plane. This is achieved by flexible coiled hydraulic hoses 7 and 8, hose 7 connecting input interface 4 with the accumulator 1 via a passageway 9 in plate 3 and hose 8 connecting output interface 5 with the accumulator 1 via a passageway 10 in plate 3. The accumulator 1 sits within a sea water flooded protective cover 11 carried by the larger plate 2, although the cover could be sealed and filled with compensated fluid if deemed necessary. The protective cover 11 prevents the ingress of foreign debris and particulate matter into the assembly, which may inhibit its effective operation. As the assembly is intended for use in a subsea environment, the cover also acts to prevent marine growth on the interior of the assembly when it is utilised subsea. A collar 12 at the top of the cover 11 locates the top of the accumulator 1, preventing it from toppling, but only constraining it in the horizontal plane. Prior art assemblies in which the accumulator is constrained horizontally by guide runners arranged laterally to the accumulator, such as the assemblies shown in FR2585086, have a high level of friction due to the moment (rotational force) caused by the accumulator. This high level of friction must be overcome with, for example, grease or other lubricants, which are unsuitable for use in the subsea environment, as these may be worn off. Additionally, the runners would be vulnerable to the ingress of foreign debris, particulate matter or marine growth. These problems do not occur with the use of a collar, as shown in the embodiments of FIGS. 1-4.

With the hydraulic accumulator 1 being constraint free (neglecting minimal friction) in the vertical plane, the entire weight of the accumulator and plate 3 on which it is mounted rests on strain gauges 13, which are connected electrically to a logic controller 14, the strain gauges being located between and in engagement with plates 2 and 3. The weight of the accumulator 1 will change as the fluid level in it increases or decreases. The data received by the logic controller 14 from the strain gauges 13 will enable it to calculate the mass of fluid contained within the accumulator 1. Other data required by the logic controller to enable calculation of the available fluid in the accumulator 1 would include the density of the fluid, the pre-charge gas volume/weight, and the weight of the empty accumulator 1 and its plate 3. It may be necessary therefore to calibrate the accumulator 1 with known volumes of pre-charge gas/hydraulic fluid prior to or during initial installation. The logic controller 14 could be subsea and in communication with topside equipment or it may itself be located topside.

Figure 2:
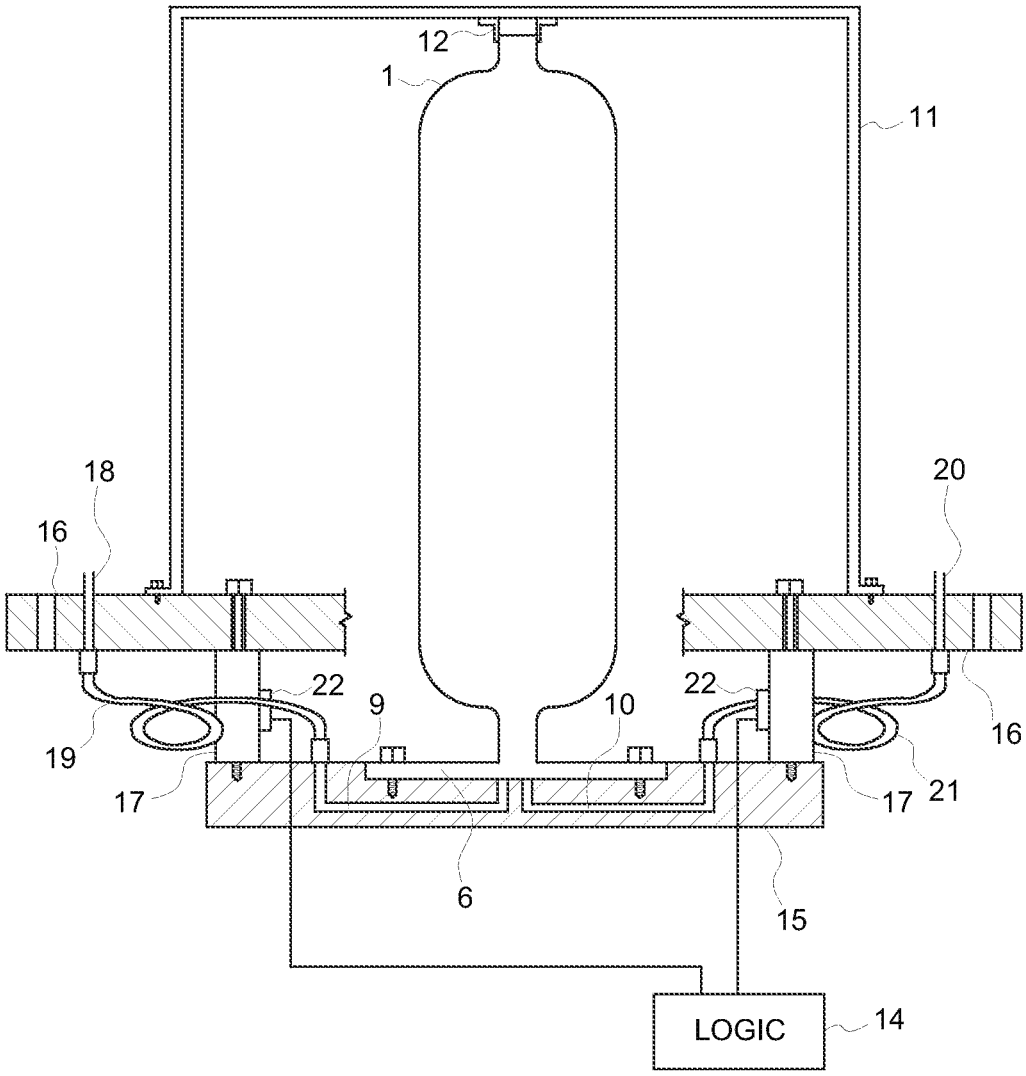
FIG. 2 is a schematic diagram of an embodiment of the present invention.

An embodiment of the present invention is illustrated in FIG. 2 (in which items that correspond with those in FIG. 1 have the same reference numerals as in FIG. 1). The hydraulic accumulator 1 is attached to a single support member in the form of a plate 15 which is suspended from an annular mounting plate 16 by attachment means in the form, for example, of four pillars 17. A hydraulic input interface 18 is connected to passageway 9 in plate 15 via a flexible, coiled hose 19 and a hydraulic output interface 20 is connected to passageway 10 in plate 15 via a flexible, coiled hose 21. The cover 11 is carried by plate 16. Strain gauges 22 are attached to respective ones of pillars 17, these strain gauges being connected electrically to a logic controller 14, which again could be subsea and in communication with topside equipment or itself be located topside. In an embodiment, there are at least two strain gauges 22 for reliability and redundancy.

As for the FIG. 1 configuration, the weight of the accumulator 1 will change as the fluid level in it increases or decreases and the data received by the logic controller 14 from the strain gauges 22 will enable it to calculate the mass of fluid contained within. Likewise, the input and output hydraulic interfaces 18 and 20 are isolated from the plate 15 by the coiled hoses 19 and 21. Unlike in FIG. 1, the strain gauges 22 in FIG. 2 are not supporting the full mass of the accumulator, and each is measuring the change of strain of a pillar 17, due to the change of weight of the accumulator 1.

Figure 3:
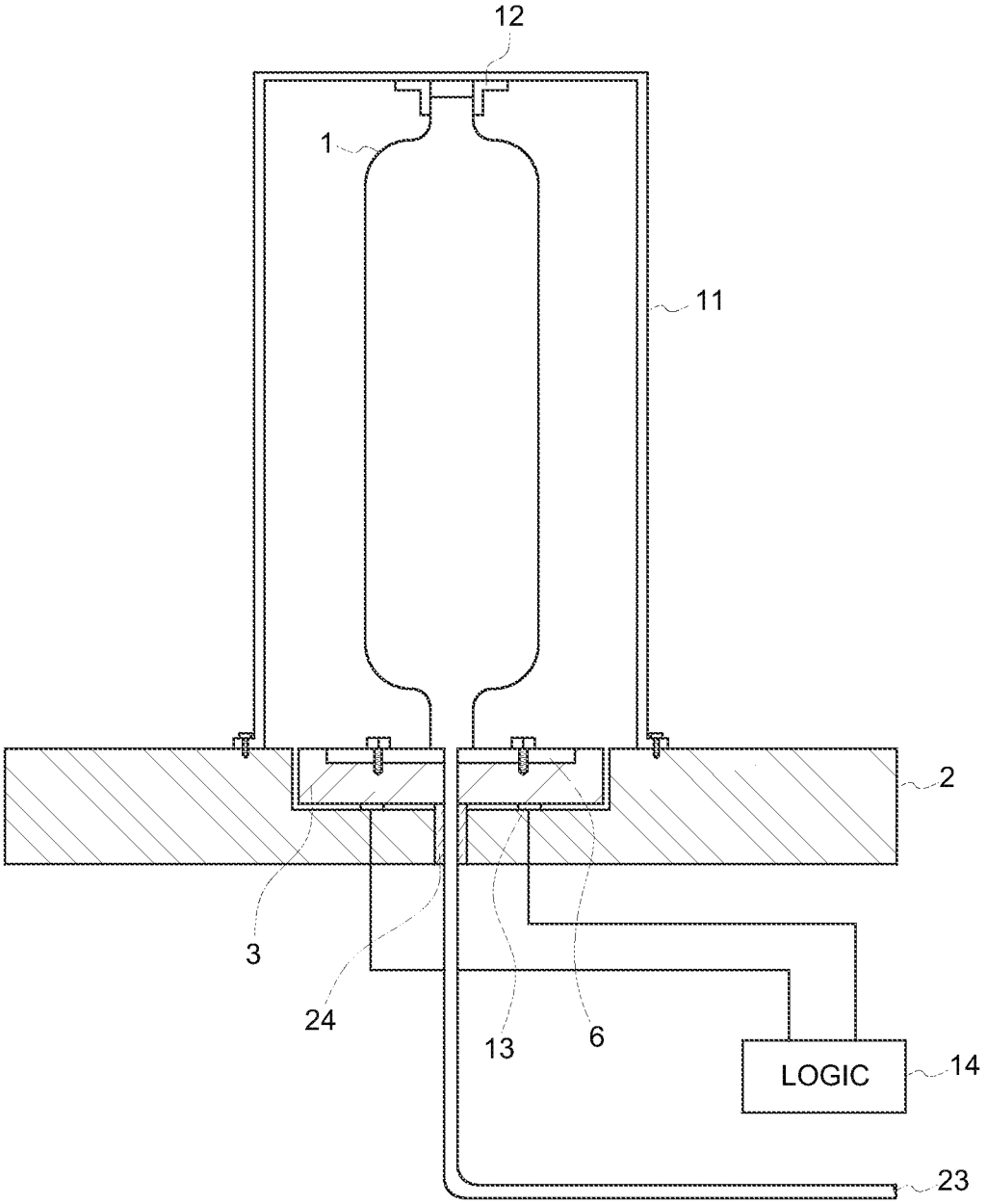
FIG. 3 is a schematic diagram of an embodiment of the present invention.

FIG. 3 illustrates a further embodiment of the present invention. Items which correspond with those in FIG. 1 have the same reference numerals as in FIG. 1. Similarly to FIG. 1, the hydraulic accumulator 1 is mounted on a pair of support plates, namely a larger plate 2 inside which there is a smaller, secondary plate 3. The hydraulic accumulator 1 is again mounted in a sea water flooded cover 11 which is mounted to the larger plate 2. However, in this embodiment the hoses 7, 8 and passageways 9, 10 are replaced with a single hydraulic input and output in communication with the accumulator, provided by a single flexible hose 23 that runs, through a seal 24, through the larger plate 2, the smaller plate 3, and into the lower surface of the accumulator 1. The arrangement of the strain gauges 13 between the larger plate 2 and smaller plate 3 and the accompanying logic controller 14 are as described with reference to FIG. 1.

Figure 4:
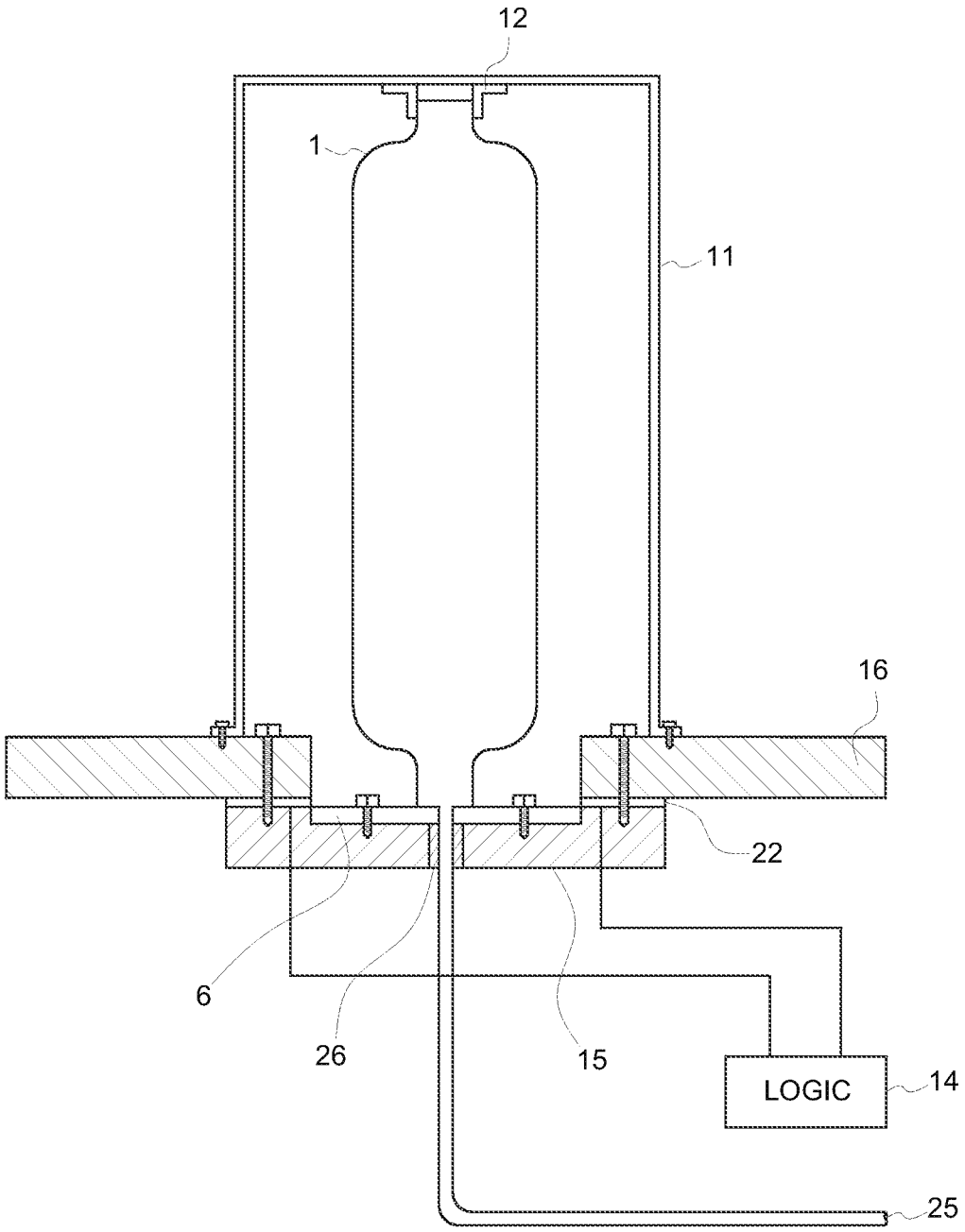
FIG. 4 is a schematic diagram of an embodiment of the present invention.

FIG. 4 illustrates a further embodiment of the present invention. Items which correspond with those in FIG. 2 have the same reference numerals as in FIG. 2. However, the hydraulic accumulator 1 is attached to a single support member in the form of a plate 15 which is attached to an annular mounting plate 16 without the use of pillars. Also, hoses 19, 21 and passageways 9,10 are replaced with a single hydraulic input and output in communication with the accumulator, provided by a single flexible hose 25 that runs, through a seal 26, through plate 15, and into the lower surface of the accumulator 1 and the strain gauges 22 are located between and in contact with the mounting plate 16 and plate 15.

In each of the embodiments shown in FIGS. 1-4 the accumulator is mounted to a fixed plate 2, 16 with the inclusion of at least one strain gauge. This provides an improvement over prior art assemblies that use a pivot or spring as the means of compliant mounting, such as the assemblies shown in FR2585086, as these assemblies may lose their calibration when used in an industrial setting, especially subsea. However, embodiments of the present invention may use any suitable means of producing an indication dependent on the weight of the accumulator—such as a strain gauge, a force gauge, a force meter, a balance scale, a spring force scale, a strain gauge based electronic scale, a device configured to take weight measurements based on the amount of fluid (for example, pneumatic or hydraulic), or a combination of any of the above.

Another possible embodiment is one in which the accumulator is on a balance beam assembly connected mechanically to a subsea gauge readable by a diver or a remotely operated vehicle.

Embodiments of the present invention enable an indication of the volume of hydraulic fluid stored in an underwater (for example subsea) accumulator at any given time. Should the indicated volume fall below a set limit, the well master control system can automatically create an alert or warning, which is flagged up to the operator at the topside control centre, that subsea valves may not have sufficient hydraulic fluid accumulated to close as required. That is, the system would be able to alert an operator of a potentially unsafe condition existing on the well of large, safety critical, tree or manifold or riser post valves. Without this indication the unsafe condition will not be identified.

While the present invention has been described with references to preferred embodiments, various changes or substitutions may be made to these embodiments by those ordinarily skilled in the art pertinent to the present invention without departing from the technical scope of the present invention. Therefore, the technical scope of the present invention encompasses not only those embodiments described above, but also all that fall within the scope of the appended claims.

What is claimed is:

1. A hydraulic accumulator assembly comprising:

a hydraulic accumulator in an underwater fluid extraction well facility associated with at least one responsive unit, wherein the at least one responsive unit is responsive to the weight of the accumulator, and is configured to provide an indication dependent on the weight of the accumulator at least one support to support the accumulator, the at least one responsive unit responsive to a force applied to a part of the at least one support by the weight of the accumulator; and a cover for the accumulator, the cover carried by the at least one support, and wherein the accumulator is constrained horizontally by a collar at the top of the cover.

2. The assembly according to claim 1, wherein the at least one support comprises a first support member to which the accumulator is attached and a second support member for the first support member, and the at least one responsive unit is responsive to a force between the first support member and the second support member.

3. The assembly according to claim 2, further comprising the cover for the accumulator, wherein the cover is carried by the second support member.

4. The assembly according to claim 2, wherein the first support member is at least partially received by the second support member.

5. The assembly according to claim 1, further comprising a single hydraulic input and output in communication with the accumulator.

6. The assembly according to claim 2, further comprising a hydraulic input interface and a hydraulic output interface in the second support member, wherein the interfaces communicate with passageways in the first support member for supplying fluid to and receiving fluid from the accumulator.

7. The assembly according to claim 6, wherein the interfaces communicate with the passageways via flexible hoses.

8. The assembly according to claim 1, wherein the at least one support comprises a support member to which the accumulator is attached and at least one further support member attached by an attachment element to the support member, and the at least one responsive unit is responsive to a force applied to the attachment element.

9. The assembly according to claim 8, further comprising the cover for the accumulator, wherein the cover is carried by the at least one further support member.

10. The assembly according to claim 8, further comprising a single hydraulic input and output in communication with the accumulator.

11. The assembly according to claim 8, further comprising a hydraulic input interface and a hydraulic output interface in the at least one further support member, wherein the interfaces communicate with passageways in the support member for supplying fluid to and receiving fluid from the accumulator.

12. The assembly according to claim 11, wherein the hydraulic input interface and the hydraulic output interface communicate with the passageway by way of flexible hoses.

13. The assembly according to claim 8, wherein the at least one further support member is above the support member in use of the assembly.

14. The assembly according to claim 1, wherein the at least one responsive unit comprises at least one of a strain gauge, a force gauge, a force meter, a balance scale, a spring force scale, a strain gauge based electronic scale, and a fluid-based weight measurement device.

15. The assembly according to claim 1, further comprising a device configured to receive and to process data resulting from the indication dependent on the weight of the accumulator.

16. A method of monitoring the volume of a fluid in a hydraulic accumulator, the method comprising:

using a hydraulic accumulator assembly that comprises hydraulic accumulator in an underwater fluid extraction well facility, wherein the accumulator is associated with at least one responsive unit, wherein the at least one responsive unit is responsive to the weight of the accumulator;

using the at least one responsive unit to provide an indication of the weight of the accumulator;

supporting the accumulator by at least one support, wherein the at least one responsive unit is responsive to a force applied to a part of the at least one support by the weight of the accumulator;

covering the accumulator by a cover, wherein the cover is carried by the at least one support; and constraining the accumulator horizontally by a collar at the top of the cover.

* * * * *